US010479627B2

(12) United States Patent
Ishida

(10) Patent No.: US 10,479,627 B2
(45) Date of Patent: Nov. 19, 2019

(54) SHEET STACKING APPARATUS AND IMAGE FORMING APPARATUS

(71) Applicant: CANON KABUSHIKI KAISHA, Tokyo (JP)

(72) Inventor: Toshiki Ishida, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/979,838

(22) Filed: May 15, 2018

(65) Prior Publication Data

US 2019/0135559 A1 May 9, 2019

(30) Foreign Application Priority Data

May 19, 2017 (JP) ..... 2017-100257

(51) Int. Cl.
*B65H 1/04* (2006.01)
*B65H 1/30* (2006.01)
*B65H 1/26* (2006.01)

(52) U.S. Cl.
CPC ..... *B65H 1/04* (2013.01); *B65H 1/266* (2013.01); *B65H 1/30* (2013.01);
(Continued)

(58) Field of Classification Search
CPC .... B65H 1/04; B65H 1/266; B65H 2301/363; B65H 2301/4222; B65H 2405/10; B65H 2405/11; B65H 2405/1116; B65H 2405/11161; B65H 2405/1122; B65H 2405/1142; B65H 2405/11425; B65H 2405/1144; B65H 2511/11
(Continued)

(56) References Cited

U.S. PATENT DOCUMENTS 8,083,224 B2 * 12/2011 Bridges ..... B65H 1/266 271/145
8,087,664 B2 1/2012 Imai
(Continued)

FOREIGN PATENT DOCUMENTS

JP 04-075840 U 7/1992
JP 2010-006596 A 1/2010

OTHER PUBLICATIONS

U.S. Appl. No. 15/928,296, Fumihiko Hayayumi Toshiki Ishida, filed Mar. 22, 2018.
U.S. Appl. No. 15/988,468, Toshiki Ishida Fumihiko Hayayumi, filed May 24, 2018.

*Primary Examiner* — Ernesto A Suarez
(74) *Attorney, Agent, or Firm* — Venable LLP

(57) ABSTRACT

A sheet stacking apparatus includes a sheet stacking unit configured to stack a sheet thereon and a sheet regulating unit configured to regulate a position of a sheet stacked on the sheet stacking unit. The sheet regulating unit includes a main body movable with respect to the sheet stacking unit and an operating portion having a pressable pressure surface, moved from a first position to a second position by pressing the pressure surface, and pivotably supported on the main body about a pivoting fulcrum positioned above a middle position of the pressure surface, the main body being regulated from moving with respect to the sheet stacking unit when the operating portion is in the first position, and the main body being allowed to move with respect to the sheet stacking unit when the operating portion is in the second position.

7 Claims, 14 Drawing Sheets

(52) U.S. Cl.
CPC ..... *B65H 2301/4222* (2013.01); *B65H 2405/112* (2013.01); *B65H 2405/1122* (2013.01); *B65H 2511/11* (2013.01)

(58) Field of Classification Search
USPC ..... 271/171
See application file for complete search history.

(56) References Cited

U.S. PATENT DOCUMENTS

| | | | | |
|---|---|---|---|---|
| 8,267,258 | B2 * | 9/2012 | Allwright | B65H 1/00 211/59.3 |
| 8,770,578 | B2 * | 7/2014 | Yamamoto | B65H 1/266 271/171 |
| 9,714,146 | B2 | 7/2017 | Ishida et al. | |
| 9,746,807 | B2 * | 8/2017 | Nishioka | G03G 15/6502 |
| 9,938,095 | B2 * | 4/2018 | Kaiga | B65H 1/266 |
| 10,106,343 | B2 * | 10/2018 | Kimura | B65H 1/266 |
| 2006/0222434 | A1 * | 10/2006 | Kitamura | B65H 1/04 400/624 |
| 2010/0270735 | A1 * | 10/2010 | Allwright | B65H 1/266 271/171 |
| 2015/0102552 | A1 * | 4/2015 | Doshida | B65H 1/04 271/171 |
| 2015/0298921 | A1 * | 10/2015 | Ishikura | B65H 1/04 271/264 |
| 2016/0214810 | A1 * | 7/2016 | Nishioka | B65H 1/266 |

* cited by examiner

SHEET STACKING APPARATUS AND IMAGE FORMING APPARATUS

BACKGROUND OF THE INVENTION

Field of the Invention

The present invention relates to a sheet stacking apparatus capable of stacking sheets and an image forming apparatus including the sheet stacking apparatus.

Description of the Related Art

In a sheet stacking apparatus such as a feed cassette to be used for an image forming apparatus, regulating members including a trailing edge regulating plate and side edge regulating plates are arranged as sheet regulating units each being configured to regulate a position of stacked sheets. In many cases, each of these regulating members includes a fixing mechanism which is configured to fix the regulating members to the feed cassette and an operating portion such as a lever or a knob which releases the fixing of the fixing mechanism to enable the regulating member to be movable.

In Japanese Patent Application Laid-Open No. 2010-6596, there is disclosed a trailing edge regulating unit which is configured to regulate a trailing edge of each of sheets stacked in the feed cassette and includes a stopper configured to fix the trailing edge regulating unit to the feed cassette and a release lever for operating the stopper. The release lever is pressed in a direction away from the trailing edge of the sheet on a plan view to release the fixing of the trailing edge regulating portion with the stopper.

The release lever disclosed in Japanese Patent Application Laid-Open No. 2010-6596 is arranged in an upper part of the trailing edge regulating unit. Therefore, when a user comes into contact with the release lever from above to set a sheet bundle in the feed cassette, the release lever is sometimes unintentionally actuated to undesirably move the trailing edge regulating unit. When position misregistration of the sheets occurs as a result of the movement of the trailing edge regulating unit, for example, there is a possibility of occurrence of disadvantages such as an image position misregistration at the time of image formation and a jam during sheet conveyance.

SUMMARY OF THE INVENTION

The present invention has an object to provide a sheet stacking apparatus capable of reducing unintentional movement of a sheet regulating unit and an image forming apparatus including the sheet stacking apparatus.

According to one embodiment of the present invention, there is provided a sheet stacking apparatus, including: a sheet stacking unit configured to stack a sheet thereon; and a sheet regulating unit configured to regulate a position of a sheet stacked on the sheet stacking unit, the sheet regulating unit including: a main body movable with respect to the sheet stacking unit; and an operating portion having a pressable pressure surface, moved from a first position to a second position by pressing the pressure surface, and pivotably supported on the main body about a pivoting fulcrum positioned above a middle position of the pressure surface, the main body being regulated from moving with respect to the sheet stacking unit when the operating portion is in the first position, and the main body being allowed to move with respect to the sheet stacking unit when the operating portion is in the second position.

According to the present invention, the unintentional movement of the sheet regulating unit can be reduced.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
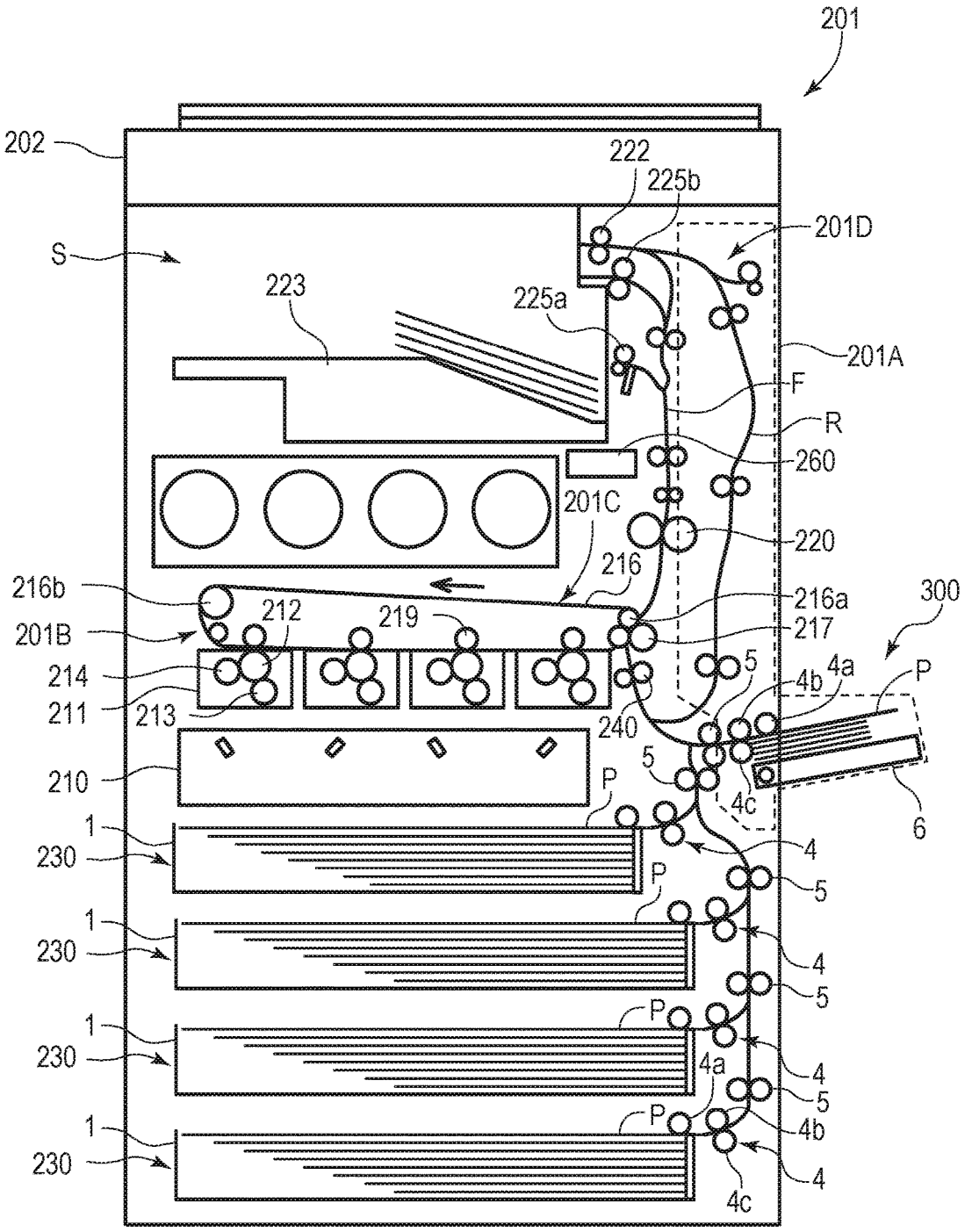
FIG. 1 is a schematic view for illustrating an image forming apparatus according to the disclosure of the present invention.

Hereinafter, an image forming apparatus according to the disclosure of the present invention is described with reference to the accompanying drawings. As illustrated in FIG. 1, an image forming apparatus 201 includes an apparatus main body 201A which accommodates an image forming section 201B, and sheet feed sections 230 and a manual feed section 300 which are capable of feeding a sheet P. The image forming apparatus 201 forms an image on the sheet P being a recording medium. Besides plain paper, the sheet P includes special paper such as coated paper, recording materials each having a special shape such as an envelope and an index sheet, plastic films for overhead projectors, and cloths.

A schema of the image forming apparatus 201 is now described. The image forming section 201B accommodated in the apparatus main body 201A is of an intermediate transfer tandem type, which includes four image forming units 211 and an intermediate transfer unit 201C. The image forming apparatus 201 includes a reading apparatus 202 provided in an upper part of the apparatus main body 201A. The reading apparatus 202 includes an automatic feed section which is configured to automatically feed an original, and an original reading section configured to read an image on the original. The image forming apparatus 201 forms an image on the sheet P based on image information read from the original and image information input from an external device.

The four image forming units 211 form a yellow (Y) toner image, a magenta (M) toner image, a cyan (C) toner image, and a black (K) toner image, respectively. The image forming units 211 have basically the same configuration except for colors of toners accommodated therein. Therefore, the image forming unit and an operation of forming the toner image are described, taking the image forming unit 211 for the yellow toner image as an example.

When the image forming unit 211 is requested to form the toner image, a photosensitive drum 212 is rotationally driven and a charging device 213 uniformly charges a surface of the photosensitive drum 212. An exposure device 210 provided below the image forming unit 211 radiates the photosensitive drum 212 with a laser beam based on the image information to expose the surface of the photosensitive drum 212 to light, thereby forming an electrostatic latent image on the photosensitive drum 212. Then, the electrostatic latent image is visualized (developed) with a toner supplied from a developing device 214 to form the toner image on the surface of the photosensitive drum 212.

In a similar manner, the toner images in the respective colors are also formed on the photosensitive drums in the other image forming units. The toner images formed by the image forming units 211 are primarily transferred from the photosensitive drums 212 onto an intermediate transfer belt 216 being an intermediate transfer member in a superimposed manner by primary transfer rollers 219. An adhering substance such as the toner remaining on the photosensitive drum 212 is removed by a cleaning device provided to each of the image forming units.

The intermediate transfer unit 201C includes the intermediate transfer belt 216 looped over a secondary transfer roller 216*a* and a tension roller 216*b*. The intermediate transfer belt 216 is rotationally driven in a direction of being dragged by the photosensitive drums 212. The toner image carried on the intermediate transfer belt 216 is secondarily transferred onto the sheet P at a secondary transfer portion formed with a secondary transfer roller 217 opposed to the inner secondary transfer roller 216*a* and the intermediate transfer belt 216. An adhering substance such as the toner remaining on the intermediate transfer belt 216 is removed by a belt cleaning device.

The sheet P which carries the toner image transferred thereon is delivered to a fixing device 220. The fixing device 220 includes a fixing roller pair which conveys the sheet P in a sandwiched manner and a heat source which heats the sheet P. The fixing device 220 applies heat and pressure to the toner image while conveying the sheet P. In this manner, the toner is molten and firmly adheres to be fixed onto the sheet P. The image forming section 201B described above is an example of an image formation unit which forms an image on a sheet, and a monochrome direct-transfer type electrophotographic unit or an ink-jet type image forming section may be used as the image forming section 201B.

In parallel to an image forming process performed by the image forming section 201B, a corresponding one of the sheet feed sections 230 performs a feeding operation for feeding the sheet P toward the image forming section 201B. The sheet feed section 230 which is built in the apparatus main body 201A includes a feed cassette 1 serving as a sheet storing portion capable of storing the sheet P therein and a feed unit 4 serving as a sheet feed unit which feeds the sheet P from the feed cassette 1. The feed unit 4 includes a pickup roller 4*a* which picks up the sheet P from the feed cassette 1 and a feed roller 4*b* which receives the sheet P from the pickup roller 4*a* and conveys the sheet P. Further, the feed unit 4 includes a retard roller 4*c* which is held in pressure contact with the feed roller 4*b* and can separate the sheet P conveyed by the feed roller 4*b* from other sheets. The feed unit 4 is an example of the sheet feed unit, and may be replaced by other feed mechanisms such as a separation-pad type feed mechanism or an air-feed type feed mechanism.

The manual feed section 300 in which a user can manually place the sheet P is provided to a side portion of the apparatus main body 201A. The manual feed section 300 includes a manual feed tray 6 which can be opened and closed with respect to the apparatus main body 201A and a feed unit which feeds the sheet P placed in the manual feed tray 6. A configuration of the feed unit is similar to that of each of the sheet feed sections 230 built in the apparatus main body 201A, and the description thereof is herein omitted.

The sheet P fed from any one of the sheet feed sections 230 and the manual feed section 300 is conveyed to a registration portion 240 via a pullout roller pair 5. The registration portion 240 performs skew feed correction on the sheet P and feeds the sheet P toward the secondary transfer portion in accordance with progress of the operation of forming the toner images in the image forming section 201B. Then, the sheet P carrying the image formed thereon as a result of the passage through the secondary transfer portion and the fixing device 220 is delivered to a delivery roller pair 225*a* at a lower level or a delivery roller pair 225*b* at an upper level through a delivery path F to be delivered to a delivery section 223 arranged in an occupancy space S in the apparatus main body 201A. For duplex printing, after the sheet P is guided to a reverse conveyance portion 201D by a switching member and is switched back by a reverse roller pair 222, the sheet P is conveyed to the image forming section 201B through a re-conveyance path R. Then, after the image is formed on a back surface of the sheet P, the sheet P is delivered by the delivery roller pair 225*a* or 225*b*.

[Feed Cassette]

Next, a basic configuration of the feed cassette 1 being an example of the sheet stacking apparatus is described with reference to FIG. 2A and FIG. 2B. The feed cassette 1 is mounted in the apparatus main body 201A so as to be drawable from the apparatus main body 201A of the image forming apparatus.

Figure 2A:
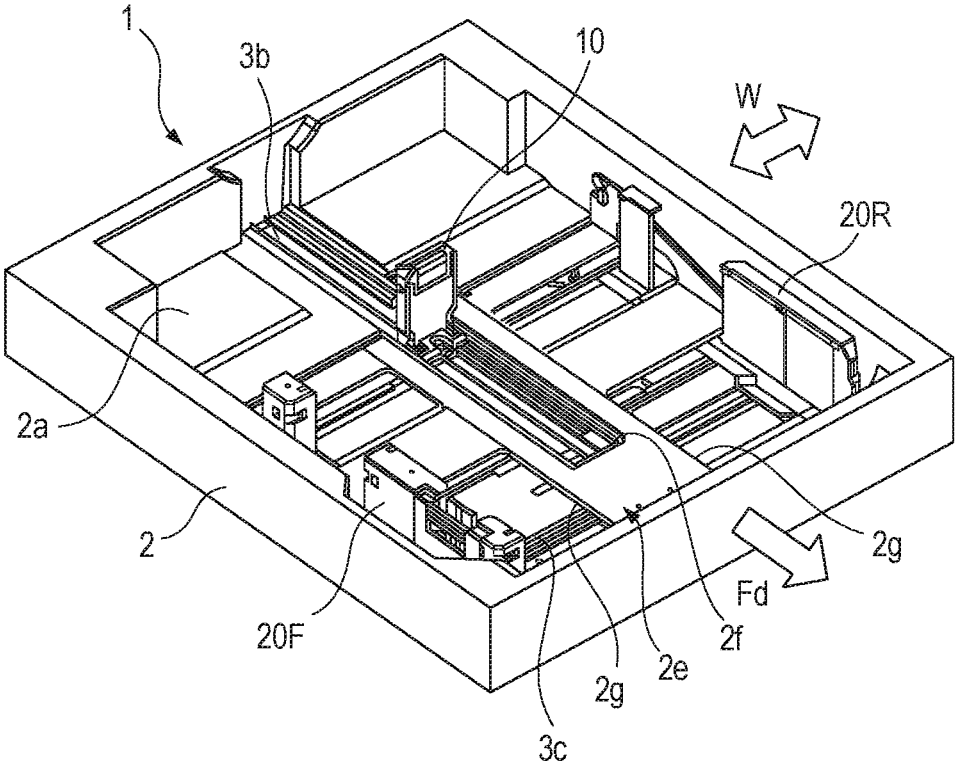
FIG. 2A is a perspective view of a feed cassette of the image forming apparatus.
Figure 2B:
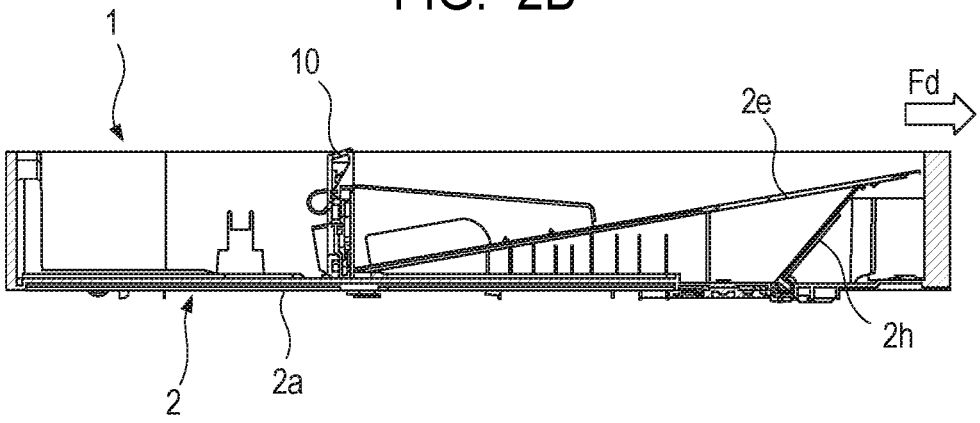
FIG. 2B is a sectional view of the feed cassette.

As illustrated in FIG. 2A, the feed cassette 1 includes a cassette main body 2 having a box-like shape, which forms a space for accommodating the sheet P, and an intermediate plate 2*e* which can be raised and lowered with respect to the cassette main body 2. The cassette main body 2 serving as a sheet storing portion is movable along a rail provided to the apparatus main body 201A. Further, the cassette main body 2 can be removed and inserted with respect to the apparatus main body 201A by operating a gripping portion provided to a front-side side surface of the image forming apparatus. A lower surface of the intermediate plate 2*e* serving as a vertically-movable plate which can be raised and lowered with respect to the sheet storing portion is supported on a lift plate 2*h* which is pivotable with respect to a bottom portion 2*a* of the cassette main body 2, as illustrated in FIG. 2B.

The lift plate 2*h* is coupled to a drive source such as a motor which is mounted in the apparatus main body 201A so as to be driven thereby under a state in which the cassette main body 2 is inserted in the apparatus main body 201A. When the image is formed using the sheet P of the sheets stacked in the feed cassette 1, the intermediate plate 2*e* is raised to a position at which the sheet can be fed by the feed unit based on a detection signal of a sheet-height detection sensor arranged above the intermediate plate 2*e*. In the apparatus main body 201A (see FIG. 1) of the image forming apparatus, a control unit 260, which performs overall control on the operations of the sheet feed sections 230, which include an operation of raising and lowering the intermediate plate 2*e* and drive of the feed units 4, and an operation of each of the sections and units of the image forming apparatus 201, is provided.

In the feed cassette 1, a trailing edge regulating plate 10 and side edge regulating plates 20F and 20R which regulate a sheet position of the sheet P supported on the intermediate plate 2*e* are arranged, as illustrated in FIG. 2A. The trailing edge regulating plate 10 and the side edge regulating plates 20F and 20R, each being an example of a sheet regulating unit capable of regulating the sheet position, are supported in the cassette main body 2 so as to be movable. The trailing edge regulating plate 10 is a trailing edge regulating member which is movable in a direction along a sheet feed direction Fd for the feed units and can be brought into contact with a trailing edge of the sheet P, specifically, an upstream edge of the sheet P in the sheet feed direction Fd. The side edge regulating plates 20F and 20R are a pair of side edge regulating plates, which is relatively movable in a width direction W perpendicular to the sheet feed direction Fd, and can be brought into contact with side edges of the sheet P, specifically, edges of the sheet P in the width direction W. The side edge regulating plates 20F and 20R are moved in a symmetrical manner about a middle position of the intermediate plate 2*e* in the width direction W as a center by an interlocking mechanism.

A guide groove for guiding the trailing edge regulating plate 10 along the sheet feed direction Fd and a rack portion 3*b* having a notch-like shape which is engaged with an engagement claw of the trailing edge regulating plate 10 to enable positioning of the trailing edge regulating plate 10 are formed on the bottom portion 2*a* of the cassette main body 2. Further, guide grooves for guiding the side edge regulating plates 20F and 20R along the width direction W and a rack portion 3*c* which is engaged with an engagement claw of the side edge regulating plate 20F and an engagement claw of the side edge regulating plate 20R to enable positioning of the side edge regulating plates 20F and 20R are formed on the bottom portion 2*a* of the cassette main body 2. Cutouts 2*f* and 2*g* are formed in the intermediate plate 2*e* to form spaces for allowing movement of the trailing edge regulating plate 10 and the side edge regulating plates 20F and 20R therein.

Release levers serving as operating portions which can be operated to disengage the engagement claws from the rack portions 3*b* and 3*c* are provided to the trailing edge regulating plate 10 and the side edge regulating plate 20F on the front side of the image forming apparatus, respectively. For moving the trailing edge regulating plate 10 and the side edge regulating plates 20F and 20R, the user performs a pressing operation on the release levers to enable the disengagement of the engagement claws from the rack portions 3*b* and 3*c*. Hereinafter, there are described in order embodiments in which the sheet regulating unit according to the disclosure of the present invention is applied to the trailing edge regulating plate 10 or the side edge regulating plates 20F and 20R.

First Embodiment

A trailing edge regulating plate according to a first embodiment is described with reference to FIG. 3A to FIG. 10B. FIG. 3A to FIG. 6B are views for illustrating a configuration and functions of a trailing edge regulating plate 10A having a configuration for comparison (hereinafter referred to as "comparative example"). FIG. 7A to FIG. 10B are views for illustrating a configuration and functions of a trailing edge regulating plate 10B according to the first embodiment. The trailing edge regulating plate 10B and the trailing edge regulating plate 10A of the comparative example differ from each other mainly in a release lever 12 serving as the operating portion. Hereinafter, elements common to the trailing edge regulating plates 10A and 10B are denoted by the same reference symbols, and the description thereof is appropriately omitted herein.

Figure 3A:
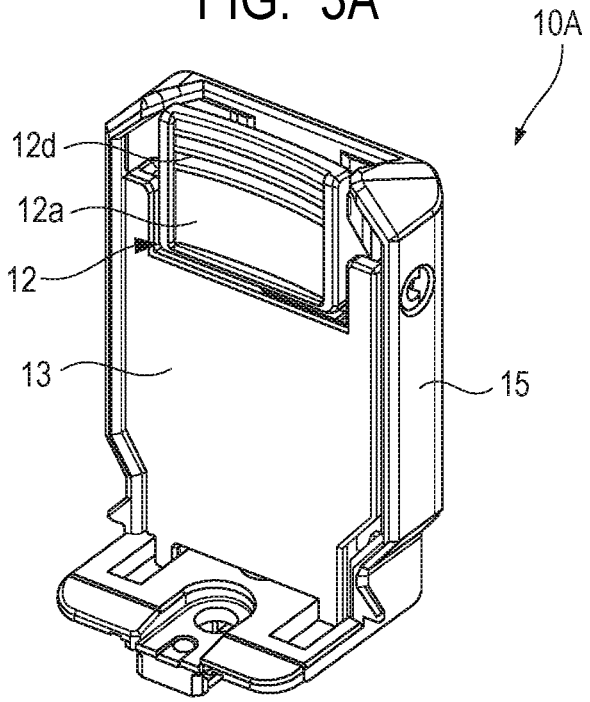
FIG. 3A is a perspective view of a trailing edge regulating plate of a comparative example.
Figure 3B:
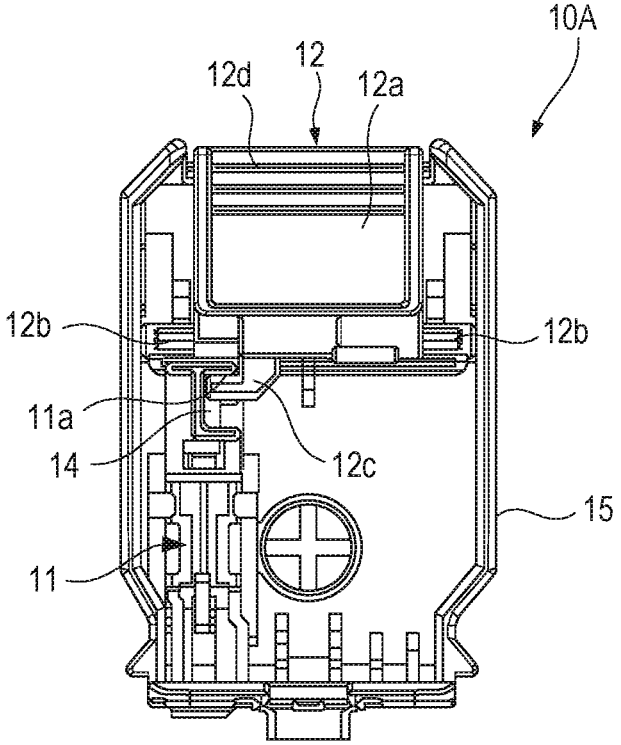
FIG. 3B is a schematic view for illustrating an internal configuration of the trailing edge regulating plate.

FIG. 3A is a perspective view of the comparative example of the trailing edge regulating plate 10A, and FIG. 3B is a schematic view for illustrating an internal configuration of the trailing edge regulating plate 10A. The trailing edge regulating plate 10A of the comparative example includes a case 15 serving as a main body to be movably supported on the cassette main body, a regulating surface 13 having a plate-like shape mounted to the case 15, and the release lever 12 pivotably supported on the case 15. The release lever 12 is a pivot member having a pressure surface 12*a* which can be pressed by the user, and a pivot shaft 12*b* being a shaft portion extending in a horizontal direction (width direction W in FIG. 2A), and is pivotable about an axis of the pivot shaft 12*b* as a center. A plurality of convex portions 12*d* which form concave and convex shapes are formed on the pressure surface 12*a* to extend in the width direction W, as a friction portion for slip prevention.

As illustrated in FIG. 3B, inside the case 15, a stopper 11 which is moved in accordance with a position of the release lever 12 is arranged as an engagement member which is engageable with the rack portion serving as an engaged portion. The stopper 11 has an engagement claw which is engageable with the rack portion and an abutment portion 11*a* which abuts against a projecting portion 12*c* of the release lever 12. The stopper 11 can be moved upward by pressing the abutment portion 11*a* with the release lever 12. The projecting portion 12*c* and the abutment portion 11*a* are included in a coupling portion which interlocks the operating portion and the engagement member with each other. Further, a spring member 14 is provided as an urging member in a compressed fashion between the stopper 11 and the case 15. The stopper 11 is urged downward, specifically, in a direction in which the engagement claw is engaged with the rack portion.

Figure 4A:
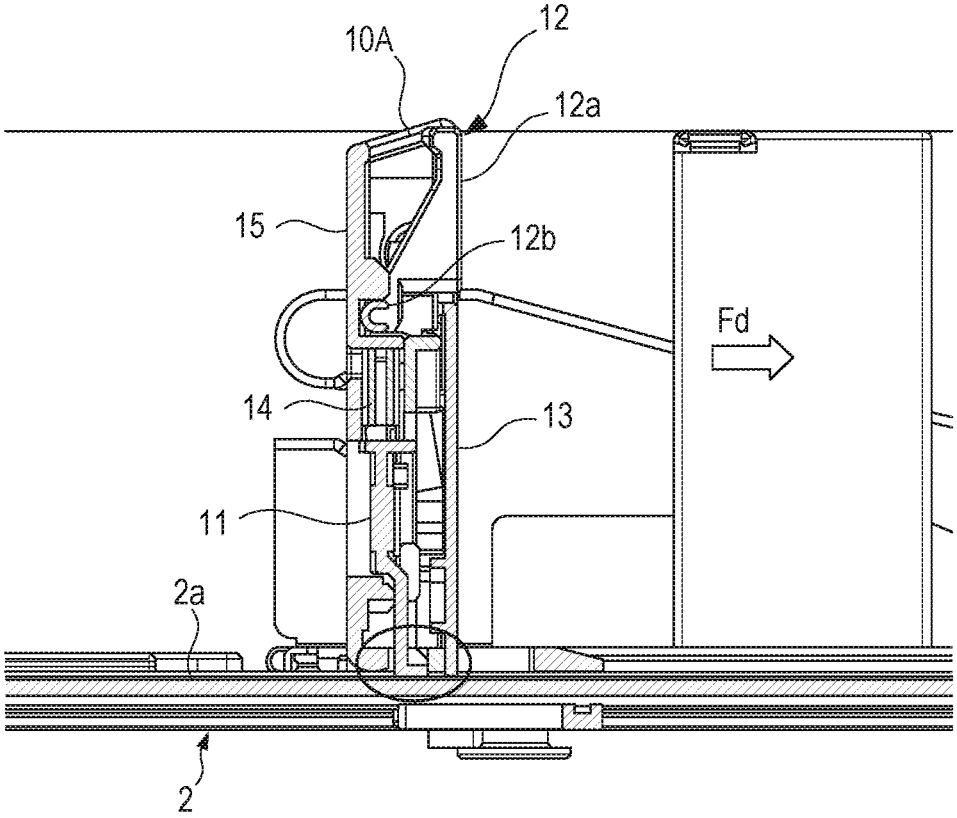
FIG. 4A is a sectional view for illustrating a state in which the trailing edge regulating plate of the comparative example is locked.

An operation of the trailing edge regulating plate 10A of the comparative example is described with reference to FIG. 4A, FIG. 4B, FIG. 5A, and FIG. 5B. FIG. 4A and FIG. 5A are sectional views of the trailing edge regulating plate 10A and the cassette main body 2 as viewed in the width direction W, and FIG. 4B and FIG. 5B are enlarged views for illustrating a main part of the trailing edge regulating plate 10A.

Figure 4B:
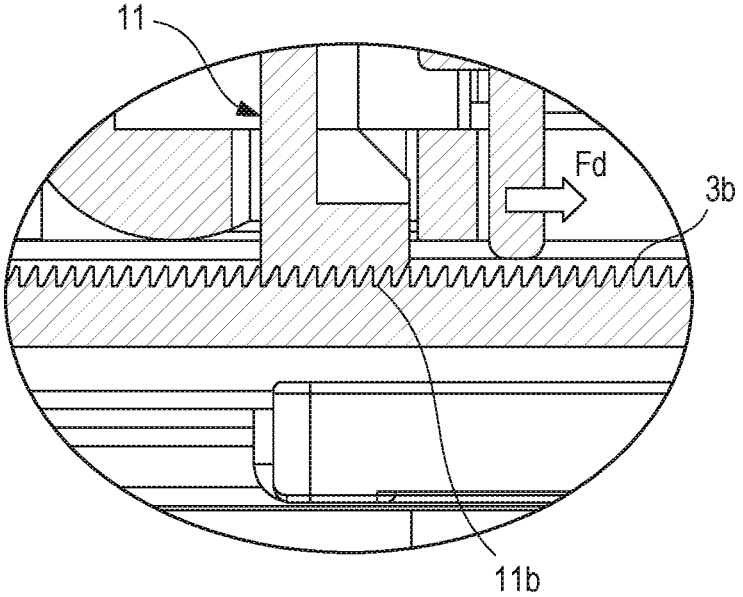
FIG. 4B is an enlarged view for illustrating a main part of the trailing edge regulating plate in the locked state.
Figure 5A:
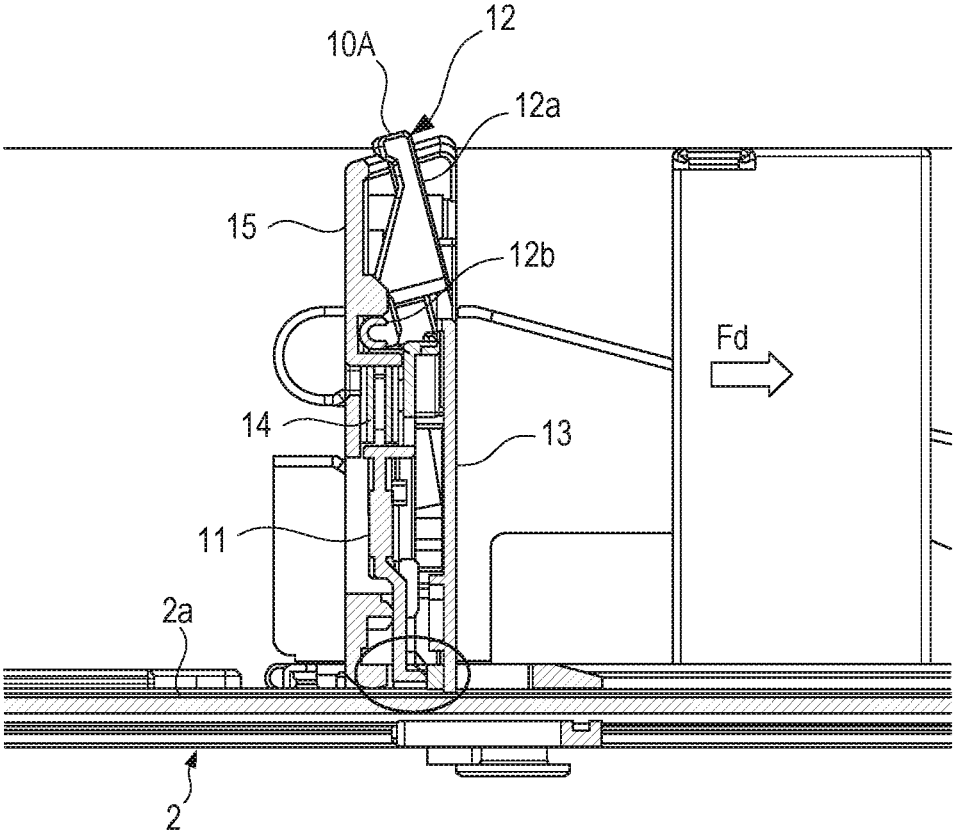
FIG. 5A is a sectional view for illustrating a state in which the trailing edge regulating plate of the comparative example is unlocked.

As illustrated in FIG. 4A and FIG. 4B, when a pressing operation is not performed on the release lever 12, the stopper 11 is held by an urging force of the spring member 14 in a lower position at which the engagement claw 11*b* is engaged with the rack portion 3*b*. At this time, the trailing edge regulating plate 10A is locked to the rack portion 3*b*, and hence movement of the trailing edge regulating plate 10A relative to the cassette main body 2 is regulated. Further, the release lever 12 is subjected to the urging force of the spring member 14 through the stopper 11 to be held in a neutral position at which the pressure surface 12*a* has a posture parallel to the regulating surface 13.

Figure 5B:
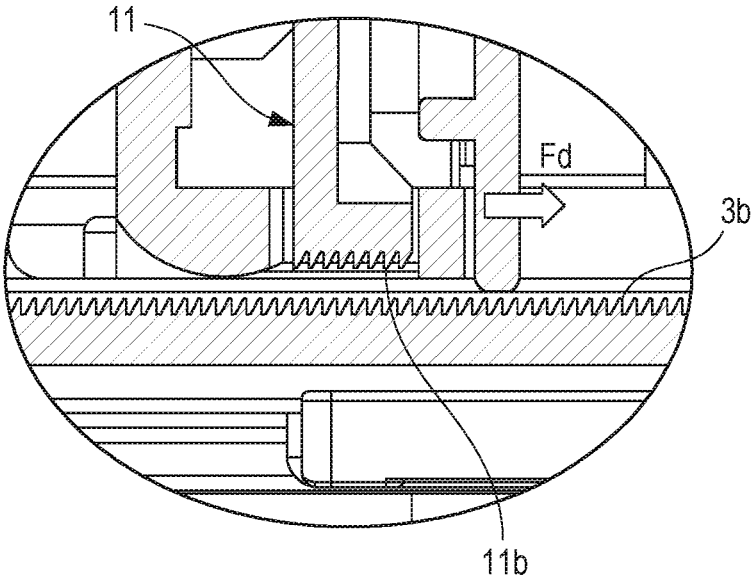
FIG. 5B is an enlarged view of the main part of the trailing edge regulating plate in the unlocked state.

As illustrated in FIG. 5A and FIG. 5B, when the pressing operation is performed on the pressure surface 12*a* of the release lever 12 to pivot in a counterclockwise direction in FIG. 5A, the pressing force on the release lever 12 is transmitted to the stopper 11 through the coupling portion. Then, the stopper 11 is moved upward against the urging force of the spring member 14. As a result, the stopper 11 is moved to an upper position at which the engagement claw 11*b* is disengaged from the rack portion 3*b*, thereby allowing the movement of the trailing edge regulating portion 10A with respect to the cassette main body 2.

As illustrated in FIG. 4B and FIG. 5B, the rack portion 3*b* has a saw-teeth shape with each tooth being inclined toward the sheet feed direction Fd (to the right side in FIG. 4B and FIG. 5B). Therefore, under a state in which the engagement claw 11*b* of the stopper 11 is engaged with the rack portion 3*b*, the movement of the trailing edge regulating plate 10A to an upstream side in the sheet feed direction Fd is strongly regulated. Thus, even when the sheet pushes the regulating surface 13, the position of the trailing edge regulating plate 10A is maintained.

For moving the trailing edge regulating plate 10A to a downstream side in the sheet feed direction Fd, specifically, in a direction toward the trailing edge of the sheet, a back surface of the case 15, specifically, a side surface of the trailing edge regulating plate 10A on a side opposite to the regulating surface 13 is only required to be pressed along the sheet feed direction Fd. In this manner, the engagement claw 11*b* of the stopper 11 retreats upward along inclined surfaces of the teeth of the rack portion 3*b*. Therefore, the user can move the trailing edge regulating plate 10A without operating the release lever 12.

For moving the trailing edge regulating plate 10A in a direction away from the trailing edge of the sheet, the user is only required to press the pressure surface 12*a* of the release lever 12 to the upstream side in the sheet feed direction Fd. In this manner, the stopper 11 is disengaged from the rack portion 3*b* to allow the movement of the trailing edge regulating plate 10A, while the trailing edge regulating plate 10A is moved by the pressing force received by the release lever 12. Specifically, a direction of operation of the release lever 12 for unlocking the trailing edge regulating plate 10A and a direction in which the trailing edge regulating plate 10A is moved coincide with each other. Therefore, the user can move the trailing edge regulating plate 10A by the single operation of pressing the pressure surface 12*a* of the release lever 12.

Regardless of whether the trailing edge regulating plate 10A is moved toward the trailing edge of the sheet to be regulated by the regulating surface 13 or is moved away therefrom, the trailing edge regulating plate 10A can be moved by the single operation of pressing the case 15 or the release lever 12 in a desired direction of movement. Hereinafter, a position at which the engagement claw 11*b* and the rack portion 3*b* are disengaged from each other after the pressure surface 12*a* of the release lever 12 is pressed to pivot from the neutral position is defined as a release position. The neutral position corresponds to a first position, whereas the release position corresponds to a second position.

[Position Misregistration of Regulating Plate]

Figure 6A:
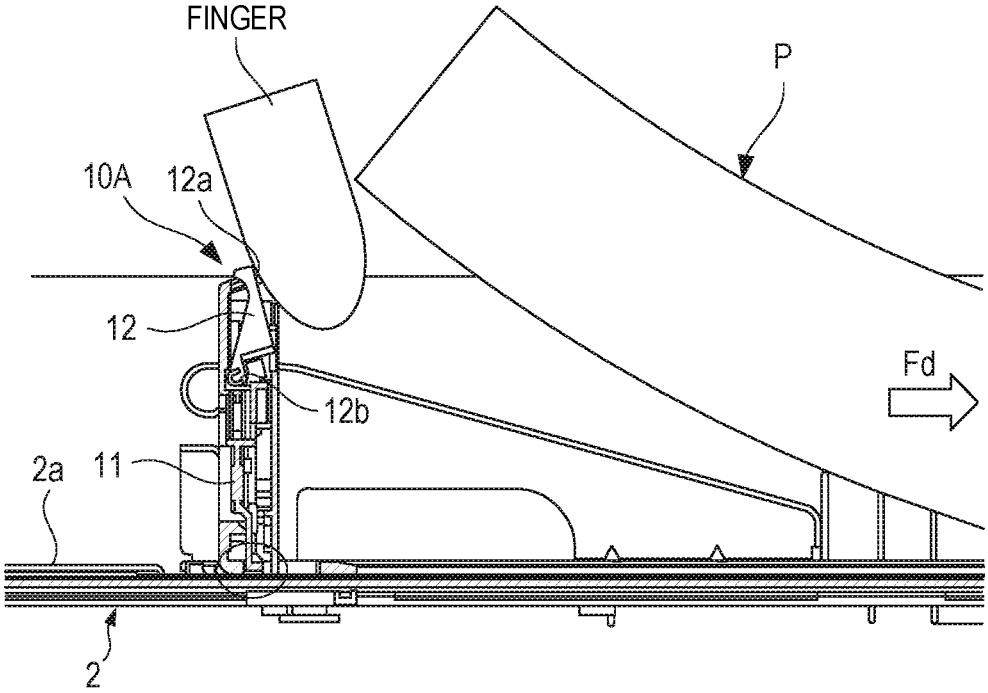
FIG. 6A is a schematic view for illustrating a case in which the trailing edge regulating plate of the comparative example is positionally misregistered.
Figure 6B:
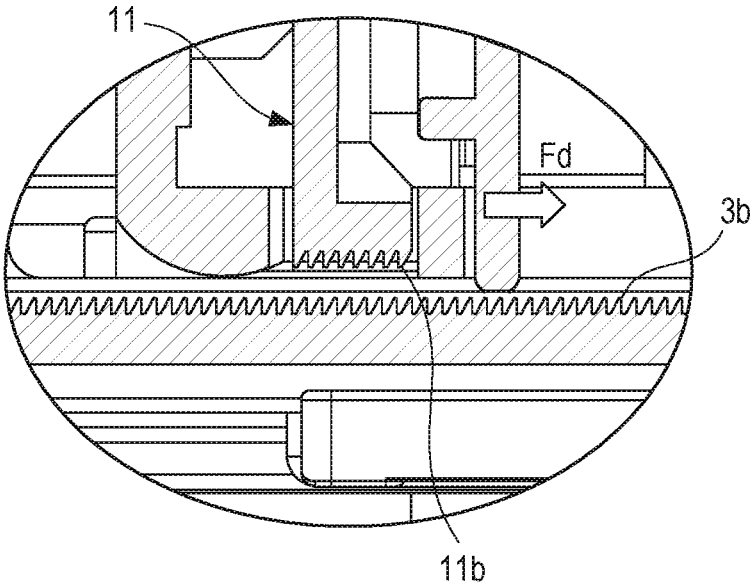
FIG. 6B is an enlarged view of the trailing edge regulating plate in the positionally misregistered state.

A case in which position misregistration of the trailing edge regulating plate 10A occurs is described with reference to FIG. 6A and FIG. 6B. When the user places the sheet P on the intermediate plate 2*e*, the user generally grips a sheet bundle with their hand to place the sheet bundle on the intermediate plate 2*e* from above under a state in which the trailing edge regulating plate 10A is moved in advance to a position corresponding to a sheet size. At this time, as illustrated in FIG. 6A and FIG. 6B, when the user's hand (finger) or the sheet bundle unintentionally comes into contact with the release lever 12, the release lever 12 sometimes undesirably pivots to the release position. When the trailing edge regulating plate 10A is unlocked thereby, the trailing edge regulating plate 10A sometimes moves toward the upstream side (left side in FIG. 6A) in the sheet feed direction Fd. As a result, the trailing edge regulating plate 10A is sometimes misregistered from a correct position corresponding to the sheet size.

When the feed cassette is inserted under a state in which the trailing edge regulating plate 10A is positionally misregistered and the sheet P is then fed, position misregistration of the sheet P occurs to cause image position misregistration. When the degree of position misregistration is significant, a jam (sheet jam) is caused thereby. Further, when the control unit of the image forming apparatus detects the sheet size based on the position of the trailing edge regulating plate 10A, an error such as the jam is sometimes caused by an erroneous detection of the sheet size.

When the user himself/herself notices the position misregistration of the trailing edge regulating plate 10A and corrects the position, the problem described above is prevented. However, an extra operation is required for the user, which leads to reduced usability. It is conceivable to set a larger play for the release lever 12, specifically, a large pivot range in which the stopper 11 is not unlocked even when the release lever 12 is pressed to pivot more than originally needed. With this configuration, however, operability is lowered.

Therefore, for the trailing edge regulating plate 10B according to the first embodiment, a pivot fulcrum of the release lever 12 is arranged above the middle position of the pressure surface 12*a*. In this manner, the position misregistration of the sheet regulating unit when an object comes into contact with the release lever 12 from above is prevented. The terms "above" or "upper" and "lower" denote a thickness direction of the sheet to be regulated by the sheet regulating unit, specifically, a direction perpendicular to the intermediate plate in a lowered state. Hereinafter, a configuration and functions of the trailing edge regulating plate 10B are described with reference to FIG. 7A to FIG. 10B.

Figure 7A:
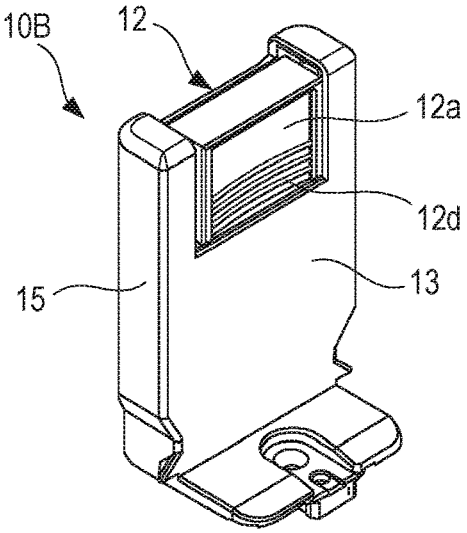
FIG. 7A is a perspective view of a trailing edge regulating plate according to a first embodiment of the present invention when the trailing edge regulating plate is positioned in a neutral position.
Figure 7B:
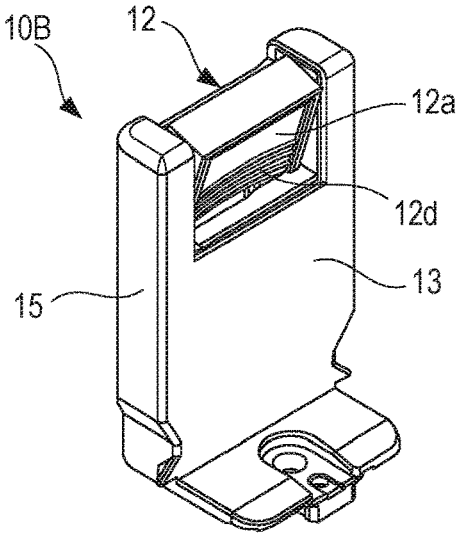
FIG. 7B is a perspective view of the trailing edge regulating plate when the trailing edge regulating plate is positioned in a release position.
Figure 7C:
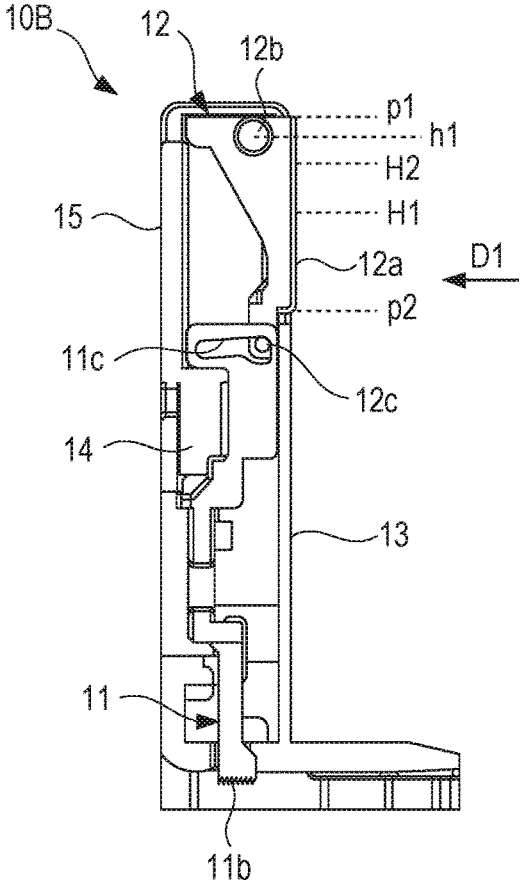
FIG. 7C is a schematic view for illustrating a sectional configuration of the trailing edge regulating plate.

FIG. 7A is a perspective view for illustrating the trailing edge regulating plate 10B when the release lever 12 is positioned in the neutral position, FIG. 7B is a perspective view for illustrating the trailing edge regulating plate 10B when the release lever 12 is positioned in the release position, and FIG. 7C is a schematic view for illustrating a sectional configuration of the trailing edge regulating plate 10B when viewed in the width direction.

The trailing edge regulating plate 10B includes the case 15 serving as the main body, which has the regulating surface 13, and the release lever 12 serving as the operating portion. As illustrated in FIG. 7C, inside the case 15, the stopper 11 as the engagement member to be engaged with the rack portion is accommodated in a vertically movable state. The stopper 11 is engaged with the projecting portion 12*c* of the release lever 12 inside an elongated hole 11*c* formed in an upper part of the stopper 11. The spring member 14 serving as the urging member for urging the stopper 11 downward is arranged between the stopper 11 and the case 15.

The release lever 12 of the trailing edge regulating plate 10B according to the first embodiment is pivotable about the pivot shaft 12*b* provided to an upper end portion of the release lever 12 as a center. An axial center (height h1) of the pivot shaft 12*b* is arranged above a middle position (height H1) of the pressure surface 12*a* when the release lever 12 is positioned in the neutral position. The middle position (H1) on the pressure surface 12*a* is defined as an intermediate position between an upper end p1 of the pressure surface 12*a* and a lower end p2 thereof. The height h1 of the axial center of the pivot shaft 12*b* is more preferably set above a height H2 (four-fold point) which is an intermediate position between the upper end p1 of the pressure surface 12*a* and the middle position of the pressure surface 12*a* when the release lever 12 is positioned in the neutral position. Further, the plurality of convex portions 12*d* serving as the friction portion are formed in a lower part of the pressure surface 12*a*, in contrast to the comparison example.

Figure 8A:
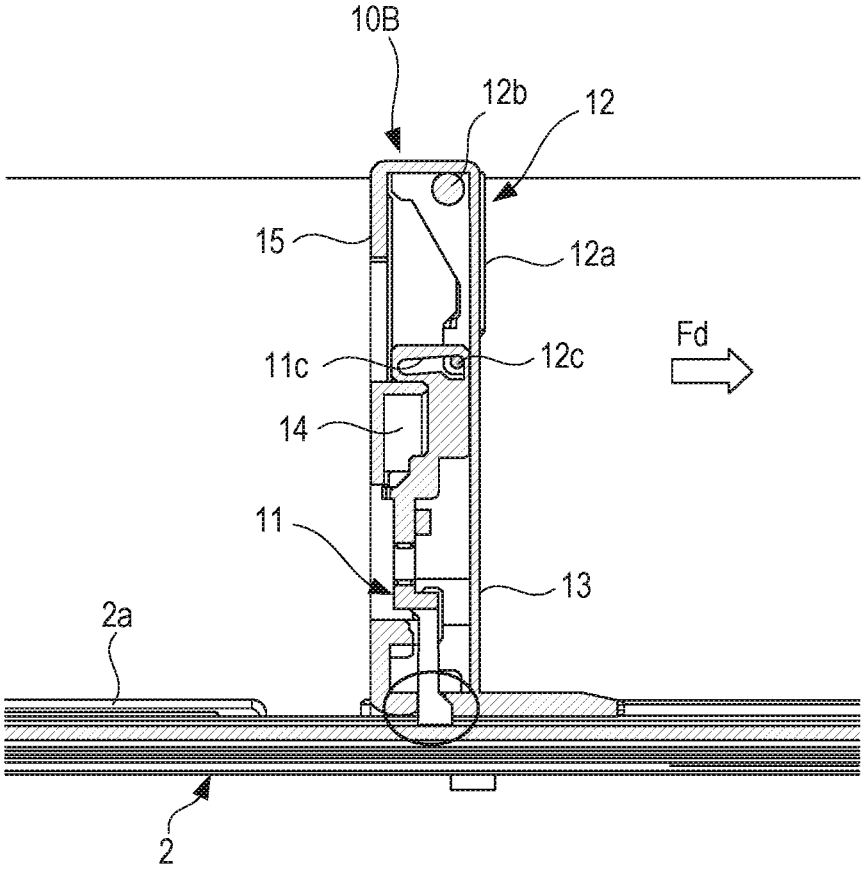
FIG. 8A is a sectional view for illustrating a state in which the trailing edge regulating plate according to the first embodiment of the present invention is locked.
Figure 8B:
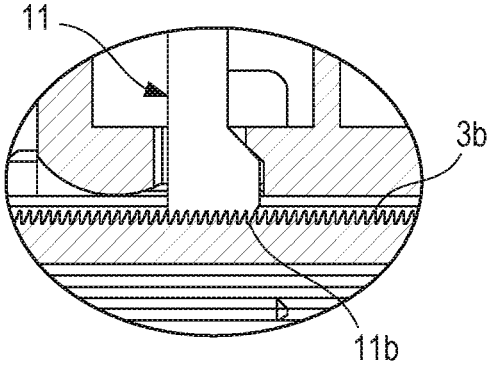
FIG. 8B is an enlarged view for illustrating a main part of the trailing edge regulating plate in the locked state.
Figure 9A:
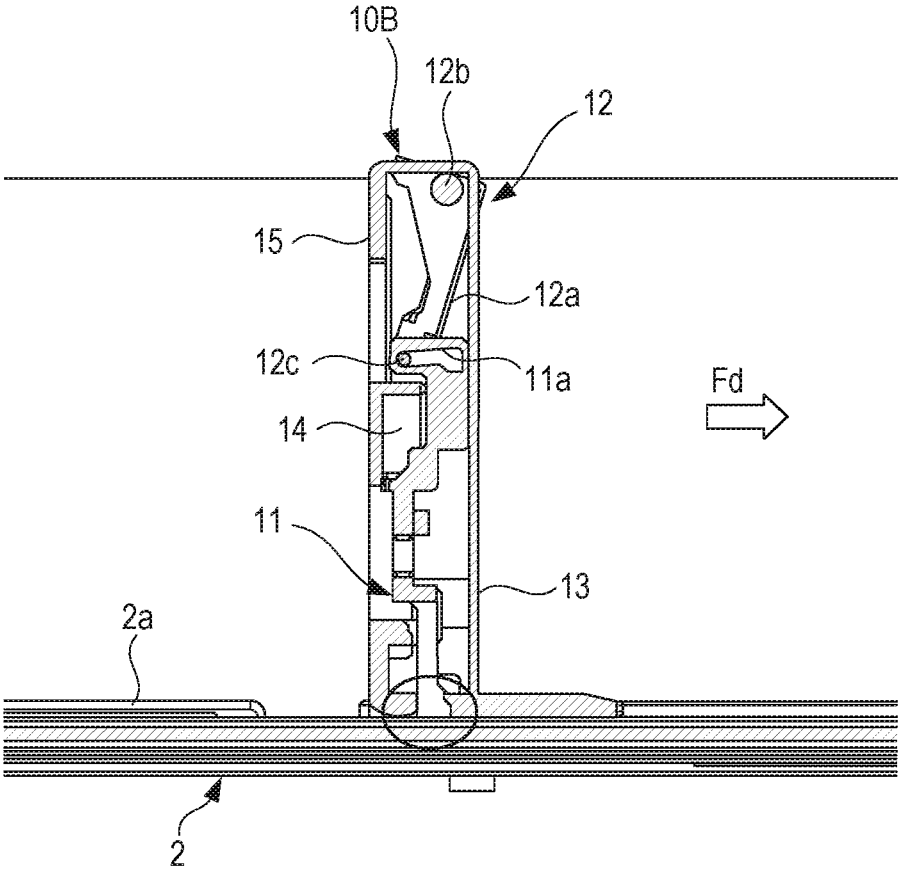
FIG. 9A is a sectional view for illustrating a state in which the trailing edge regulating plate according to the first embodiment is unlocked.
Figure 9B:
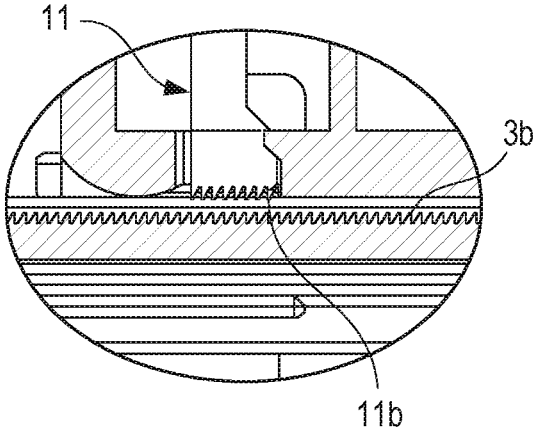
FIG. 9B is an enlarged view of the main part of the trailing edge regulating plate in the unlocked state.

An operation of the trailing edge regulating plate 10B is described with reference to FIG. 8A, FIG. 8B, FIG. 9A, and FIG. 9B. FIG. 8A and FIG. 9A are sectional views of the trailing edge regulating plate 10B and the cassette main body 2 as viewed in the width direction, and FIG. 8B and FIG. 9B are enlarged views for illustrating a main part of the trailing edge regulating plate 10B.

An operation for moving the trailing edge regulating plate 10B is similar to that in the comparative example. Specifically, as illustrated in FIG. 8A and FIG. 8B, when the pressing operation is not performed on the release lever 12, the stopper 11 is held in the lower position at which the engagement claw 11*b* is engaged with the rack portion 3*b* by the urging force of the spring member 14. At this time, the trailing edge regulating plate 10B is locked to the rack portion 3*b*, and hence the release lever 12 is held in the neutral position at which the pressure surface 12*a* has a posture parallel to the regulating surface 13. When the back surface of the case 15 is pressed in the sheet feed direction Fd in this state, the engagement claw 11*b* retreats upward along the inclined surfaces of the rack portion 3*b*. Therefore, the trailing edge regulating plate 10B is moved to the downstream side in the sheet feed direction Fd.

For moving the trailing edge regulating plate 10B to the upstream side in the sheet feed direction Fd, the pressure surface 12*a* of the release lever 12 is pressed to pivot the release lever 12 to the release position. Specifically, as illustrated in FIG. 9A and FIG. 9B, the release lever 12 is pivoted to the upstream side in the sheet feed direction Fd by pressing the pressure surface 12*a*. As a result, the stopper 11 is moved upward against the urging force of the spring member 14 to disengage the engagement claw 11*b* from the rack portion 3*b*. Therefore, the movement of the trailing edge regulating plate 10B with respect to the cassette main body 2 is allowed. Along with the allowance of movement of the trailing edge regulating plate 10B, the trailing edge regulating plate 10B is moved to the upstream side in the sheet feed direction Fd by the pressing force received by the release lever 12.

Figure 10A:
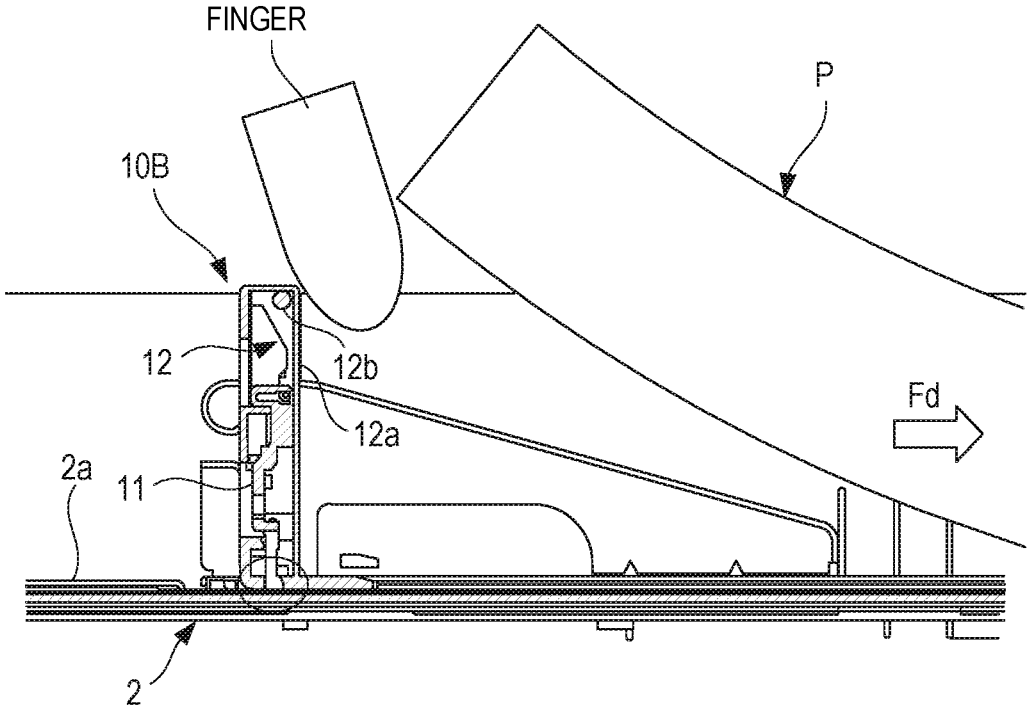
FIG. 10A is a schematic view for illustrating functions of the trailing edge regulating plate according to the first embodiment.
Figure 10B:
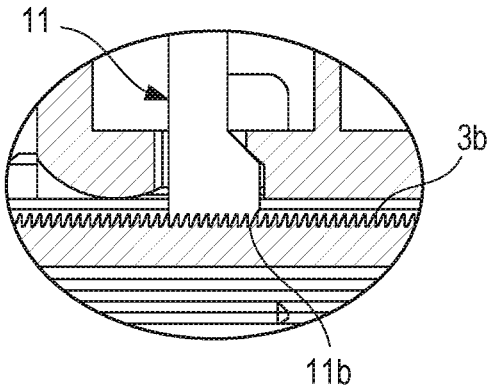
FIG. 10B is an enlarged view of the trailing edge regulating plate.

The effects of the first embodiment are described with reference to FIG. 10A and FIG. 10B. It is assumed that, when the user places the sheet P, the user's hand (finger) approaches the trailing edge regulating plate 10B from above, as illustrated in FIG. 10A. In the trailing edge regulating plate 10B according to the first embodiment, the release lever 12 pivots about the pivot shaft 12*b* located above the middle position of the pressure surface 12*a* as the pivot fulcrum. Therefore, even when the user's hand comes into contact with the release lever 12, a force for pressing the release lever 12 is mainly received at a contact portion between the pivot shaft 12*b* and the case 15, and hence the release lever 12 remains in the neutral position or in the vicinity thereof. In comparison at least to the comparative example, a distance between the upper end portion of the release lever 12 with which the user's hand is liable to come into contact and the pivot shaft 12*b* is small. Therefore, even when the user's hand comes into contact with the release lever 12, the release lever 12 is unlikely to pivot toward the release position, based on the leverage principle. Therefore, an object such as the user's hand comes into contact with the trailing edge regulating plate 10B from above, unintentional movement of the trailing edge regulating plate 10B can be prevented. Thus, the user is allowed to take appropriate measures such as redo of the placement operation.

In particular, in the first embodiment, the trailing edge regulating plate 10B can be moved to the upstream side in the sheet feed direction Fd by the single operation of pressing the release lever 12 in a predetermined pressing direction D1 (see FIG. 7C), similarly to the comparative example. In the configuration having high operability described above, the pivot fulcrum of the release lever 12 is arranged above the middle position of the pressure surface 12*a*. Therefore, ensuring of the operability of the trailing edge regulating plate 10B and reduction of the position misregistration can be both achieved.

In the first embodiment, the pivot shaft 12*b* of the release lever 12 is arranged at a height as close as possible to a height of the upper end p1 of the pressure surface 12*a*. Meanwhile, at least part of the convex portions 12*d* serving as the friction portion is arranged in the lower part of the pressure surface 12*a*. Specifically, the friction portion which allows the pressing force to be easily received when the user intentionally presses the release lever 12 is arranged at a position far from the pivot fulcrum. Therefore, the user can move the release lever 12 to the release position with a relatively small force (at least the same degree of force as that in the comparative example).

Second Embodiment

Next, a side edge regulating plate according to a second embodiment is described with reference to FIG. 11 to FIG. 14B. FIG. 11, FIG. 12A, FIG. 12B, and FIG. 12C are views for illustrating configurations and functions of the side edge regulating plates 20F and 20R as a comparative example. FIG. 13A, FIG. 13B, FIG. 14A, and FIG. 14B are views for illustrating configurations and functions of a side edge regulating plate 20*f* according to the second embodiment. Hereinafter, elements common to the side edge regulating plates 20F and 20*f* are denoted by the same reference symbols, and the description thereof is appropriately omitted herein.

Figure 11:
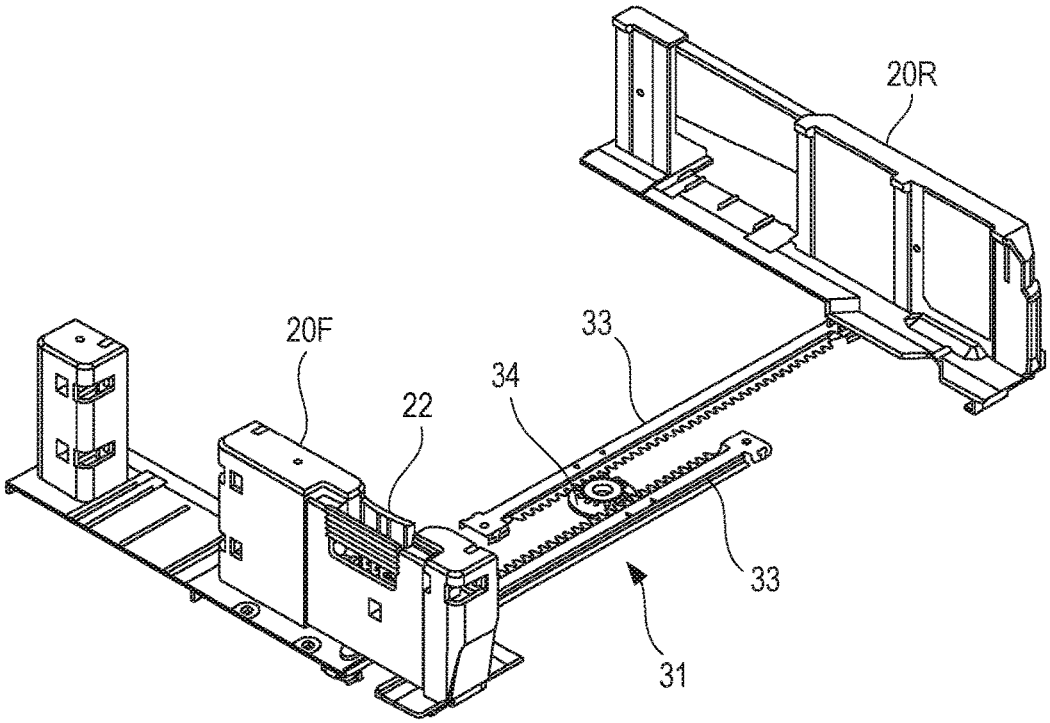
FIG. 11 is a perspective view for illustrating an interlocking mechanism for side edge regulating plates.

FIG. 11 is a perspective view of the side edge regulating plate 20F of the comparative example and the side edge regulating plate 20R which forms a pair with the side edge regulating plate 20F. The side edge regulating plates 20F and 20R are coupled by a rack and pinion mechanism 31 including rack gears 33, 33 and a pinion gear 34. Therefore, by moving any one of the side edge regulating plates 20F and 20R, another thereof is moved simultaneously. Hereinafter, the description is given, assuming that a release lever 22 which can release the lock of the side edge regulating plates 20F and 20R to the cassette main body is provided to the side edge regulating plate 20F which is positioned on the front side of the image forming apparatus.

Figure 12A:
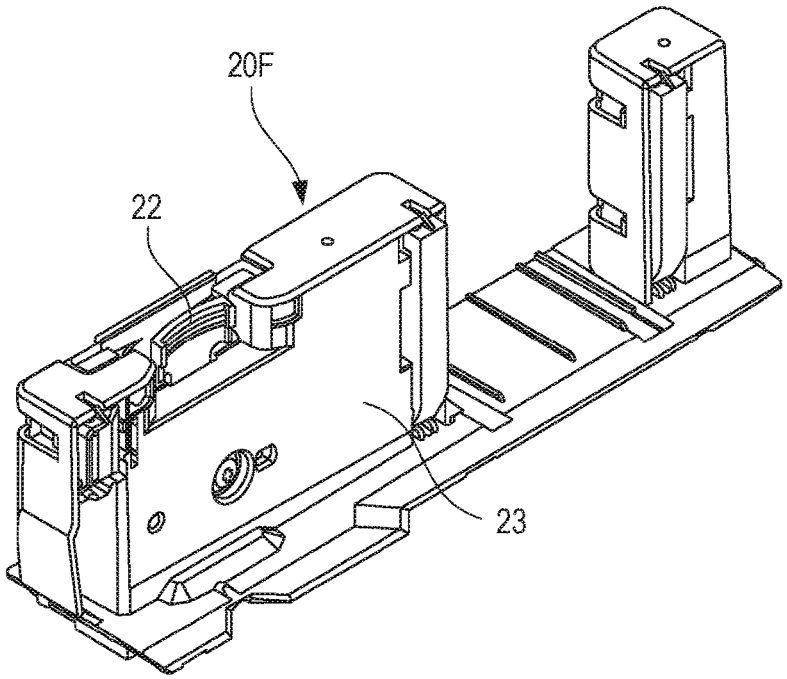
FIG. 12A is a perspective view of a side edge regulating plate of a comparative example.
Figure 12B:
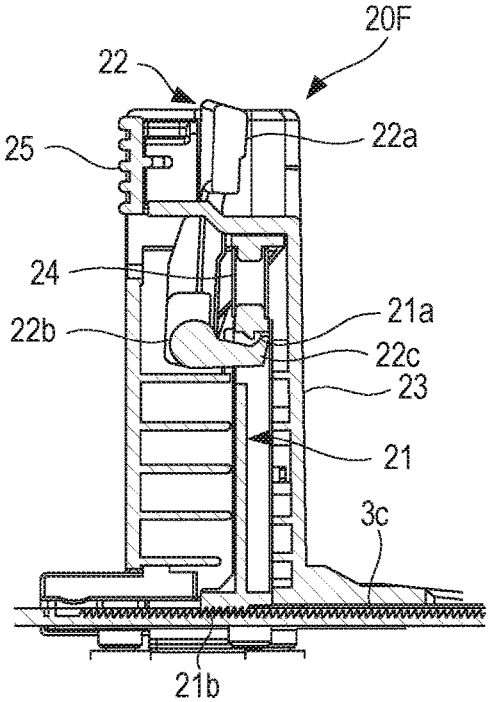
FIG. 12B is a schematic view for illustrating a sectional configuration of the side edge regulating plate which is not subjected to a pressing operation.
Figure 12C:
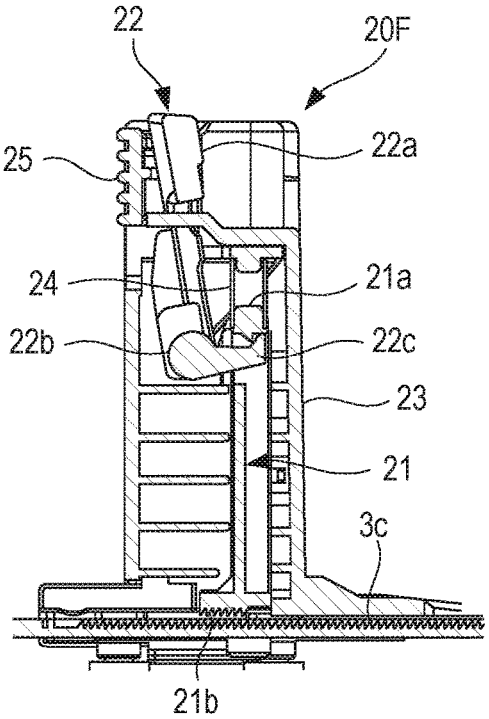
FIG. 12C is a schematic view for illustrating a sectional configuration of the side edge regulating plate which is being subjected to the pressing operation.

FIG. 12A is a perspective view of the side edge regulating plate 20F, and FIG. 12B and FIG. 12C are sectional views of the side edge regulating plate 20F. The side edge regulating plate 20F includes a case 25 serving as a main body to be movably supported on the cassette main body, a regulating surface 23 having a plate-like shape mounted to the case 25, and the release lever 22 pivotably supported on the case 25. The release lever 22 is a pivot member having a pressure surface 22*a* which can be pressed by the user, and a pivot shaft 22*b* extending in a horizontal direction (sheet supply direction Fd in FIG. 2A and FIG. 2B), and is pivotable about an axis of the pivot shaft 22*b* as a center.

Inside the case 25, a stopper 21 which is moved in accordance with a position of the release lever 22 is arranged as an engagement member which is engageable with the rack portion 3*c* serving as an engaged portion. The stopper 21 has an engagement claw 21*b* which is engageable with the rack portion 3*c* and an abutment portion 21*a* which abuts against the projecting portion 22*c* of the release lever 22. The stopper 21 can be moved upward by pressing the abutment portion 21*a* with the release lever 22. The projecting portion 22*c* and the abutment portion 21*a* are included in a coupling portion which interlocks the operating portion and the engagement member with each other. Further, a spring member 24 is provided as an urging member in a compressed fashion between the stopper 21 and the case 25. The stopper 21 is urged downward, specifically, in a direction in which the engagement claw 21*b* is engaged with the rack portion 3*c*.

As illustrated in FIG. 12B, when a pressing operation is not performed on the release lever 22, the stopper 21 is held by an urging force of the spring member 24 in a lower position at which the engagement claw 21*b* is engaged with the rack portion 3*c*. At this time, the side edge regulating plate 20F is locked to the rack portion 3*c*, and hence movement of the side edge regulating plate 20F relative to the cassette main body is regulated. Further, the release lever 22 is subjected to the urging force of the spring member 24 through the stopper 21 to be held in a neutral position.

As illustrated in FIG. 12C, when the pressing operation is performed on the pressure surface 22*a* of the release lever 22 to the left side in FIG. 12C, specifically, to an outer side in the width direction, the pressing force on the release lever 22 is transmitted to the stopper 21 through the coupling portion. Hence, the stopper 21 is moved upward against the urging force of the spring member 24. In this manner, the stopper 21 is moved to the upper position at which the engagement claw 21*b* is disengaged from the rack portion 3*c*, thereby allowing the movement of the side edge regulating plates 20F and 20R with respect to the cassette main body.

The rack portion 3*c* has a saw-teeth shape with each tooth being inclined inward in the width direction, specifically, to the right side in FIG. 12B and FIG. 12C. Therefore, in a state in which the engagement claw 21*b* of the stopper 21 is engaged with the rack portion 3*c*, the movement of the side edge regulating plate 20F to the left side in FIG. 12B is strongly regulated. Thus, even when the regulating surface 23 is pressed by the sheet, the positions of the side edge regulating plates 20F and 20R are maintained.

For reducing a distance between the side edge regulating plates 20F and 20R, a back surface of the case 25 of the side edge regulating plate 20F, specifically, a side surface on the side opposite to the regulating plate 23 is only required to be pressed inward in the width direction. As a result, the engagement claw 21*b* of the stopper 21 retreats upward along inclined surfaces of the teeth of the rack portion 3*c*. Thus, the user can move the side edge regulating plates 20F and 20R without operating the release lever 22. For increasing the distance between the side edge regulating plates 20F and 20R, the user is only required to press the pressure surface 22*a* of the release lever 22 outward in the width direction. In this manner, the stopper 21 is disengaged from the rack portion 3*c* to allow the movement of the side edge regulating plate 20F, while the side edge regulating plate 20F is moved by the pressing force received by the release lever 22 to move the another side edge regulating plate 20R in an interlocked manner therewith. Specifically, a direction of operation of the release lever 22 for unlocking the side edge regulating plate 20F and a direction of moving the side edge regulating plate 20F coincide with each other. Therefore, the user can move the side edge regulating plate 20F by the single operation of pressing the pressure surface 22*a* of the release lever 22.

Regardless of whether the distance between the side edge regulating plates 20F and 20R is increased or reduced, the side edge regulating plates 20F and 20R can be moved by the single operation of pressing any of the case 25 and the release lever 22 of the side edge regulating plate 20F. Hereinafter, after the release lever 22 is pivoted from the neutral position (first position) by pressing the pressure surface 22*a* of the release lever 22, a position at which the engagement claw 21*b* is disengaged from the rack portion 3*c* is defined as a release position (second position).

As illustrated in FIG. 12B and FIG. 12C, the pivot shaft 22*b* of the release lever 22 in the comparative example is provided inside the case 25 and arranged below the pressure surface 22*a* which is exposed on a top of the case 25. In this configuration, as described in the comparative example of the first embodiment, there is a possibility that the lock with the stopper 21 is released to cause position misregistration of the side edge regulating plates 20F and 20R by unintentional contact of the user's hand or the sheet bundle with the release lever 22.

Figure 13A:
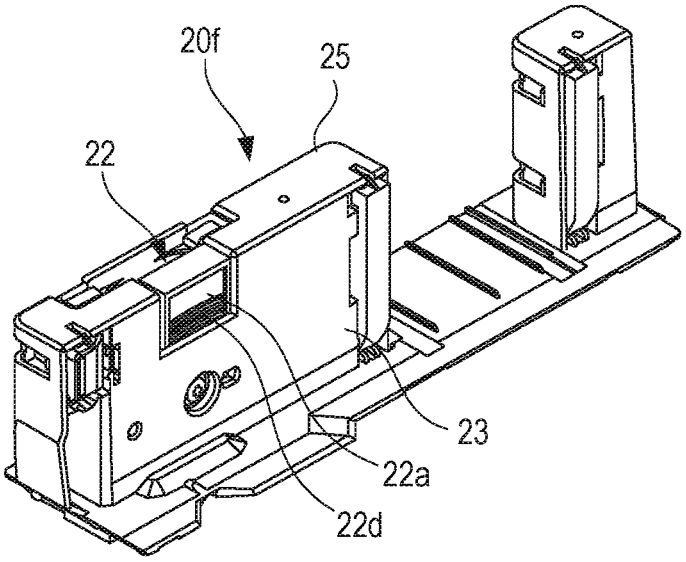
FIG. 13A is a perspective view of a side edge regulating plate according to a second embodiment of the present invention, which is not subjected to the pressing operation.

In the side edge regulating plate 20*f* according to the second embodiment, the pivot fulcrum of the release lever 22 is arranged above the middle position of the pressure surface. Hereinafter, a configuration and functions of the side edge regulating plate 20*f* are described with reference to FIG. 13A, FIG. 13B, FIG. 14A, and FIG. 14B. FIG. 13A is a perspective view for illustrating the side edge regulating plate 20*f* when the release lever 22 is positioned in the neutral position, FIG. 13B is a perspective view for illustrating the side edge regulating plate 20*f* when the release lever 22 is positioned in the release position, FIG. 14A is a sectional view of the side edge regulating plate 20*f* when the release lever 22 is positioned in the neutral position, and FIG. 14B is a sectional view for illustrating the side edge regulating plate 20*f* when the release lever 22 is positioned in the release position.

Figure 13B:
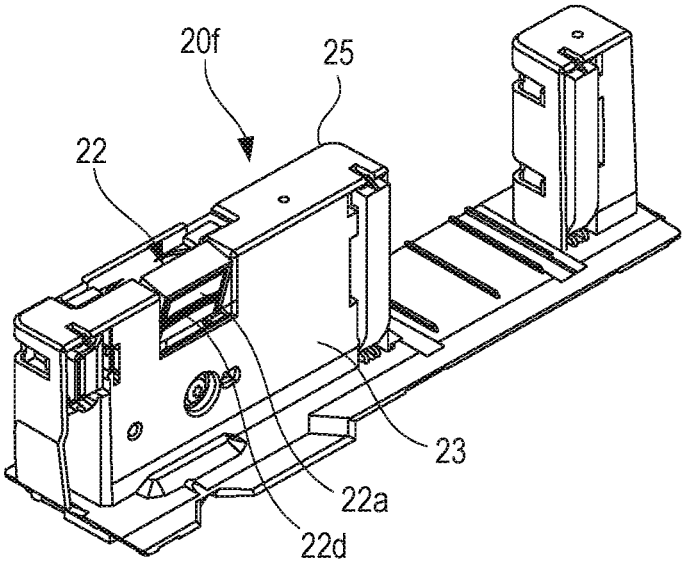
FIG. 13B is a perspective view for illustrating the side edge regulating plate which is being subjected to the pressing operation.
Figure 14A:
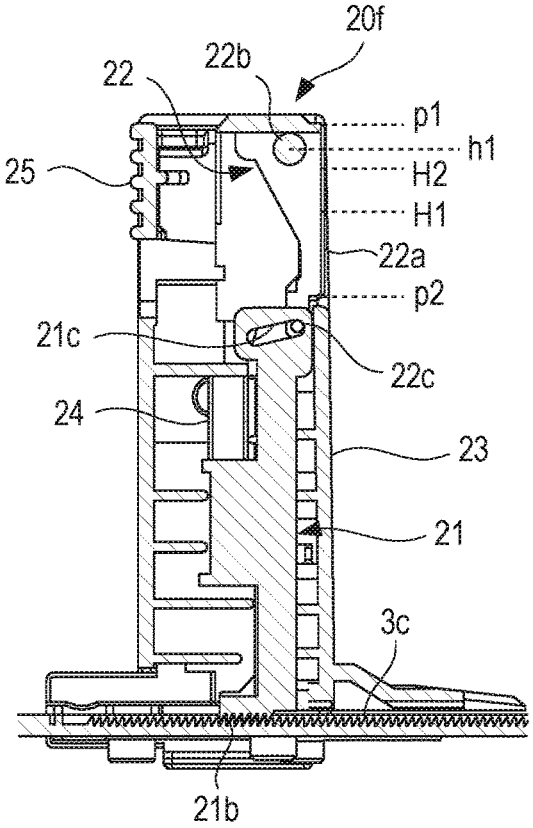
FIG. 14A is a sectional view for illustrating a state in which the side edge regulating plate according to the second embodiment is locked.
Figure 14B:
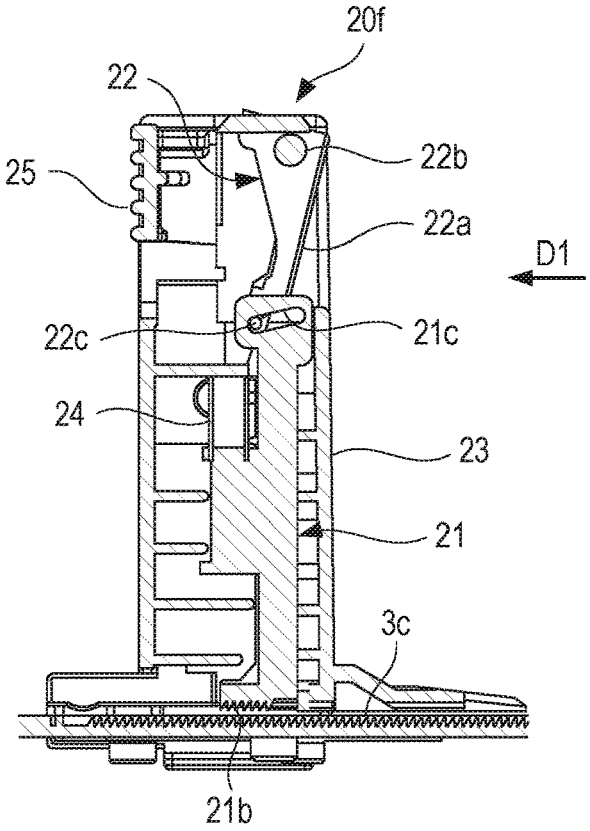
FIG. 14B is a sectional view for illustrating a state in which the side edge regulating plate is unlocked.

As illustrated in FIG. 13A and FIG. 13B, the side edge regulating plate 20*f* includes the case 25 serving as the main body, which has the regulating surface 23, and the release lever 22 serving as the operating portion. As illustrated in FIG. 14A, inside the case 25, the stopper 21 serving as the engagement member to be engaged with the rack portion 3*c* is accommodated in a vertically movable state. The stopper 21 is engaged with the projecting portion 22*c* of the release lever 22 inside an elongated hole 21*c* formed in an upper part of the stopper 21. A spring member 24 serving as the urging member for urging the stopper 21 downward is arranged between the stopper 21 and the case 25.

The release lever 22 of the side edge regulating plate 20*f* according to the second embodiment is pivotable about the pivot shaft 22*b* provided to an upper part of the release lever 22 as a pivoting fulcrum. An axial center (height h1) of the pivot shaft 22*b* is arranged above a middle position (height H1) of the pressure surface 22*a* when the release lever 22 is positioned in the neutral position. The middle position (height H1) of the pressure surface 22*a* is defined as an intermediate position between the upper end p1 of the pressure surface 22*a* and the lower end p2 thereof. The height h1 of the axial center of the pivot shaft 22*b* is more preferably set above a height H2 of an intermediate position between the upper end p1 of the pressure surface 22*a* and the middle position of the pressure surface 22*a* when the release lever 22 is positioned in the neutral position. Further, a plurality of convex portions 22*d* (see FIG. 13A) serving as the friction portion are formed in a lower part of the pressure surface 22*a*.

An operation for moving the side edge regulating plate 20*f* is similar to that in the comparative example. Specifically, for moving the side edge regulating plate 20*f* inward in the width direction, the back surface of the case 25 is pressed inward in the width direction. Then, the engagement claw 21*b* retreats upward along the inclined surfaces of the rack portion 3*c*, and hence the side edge regulating plate 20*f* is moved along the width direction. For moving the side edge regulating plate 20*f* outward in the width direction, the pressure surface 22*a* of the release lever 22 is pressed to pivot the release lever 22 to the release position. In this state, the release lever 22 is kept pressed. In this manner, the stopper 21 is disengaged from the rack portion 3*c*, while the side edge regulating plate 20*f* is moved outward in the width direction by the pressing force received by the release lever 22. Interlockingly with the side edge regulating plate 20*f*, the side edge regulating plate 20R (see FIG. 11) which forms a pair with the side edge regulating plate 20*f* is also moved inward or outward in the width direction.

In the side edge regulating plate 20*f* according to the second embodiment, the release lever 22 pivots about the pivot shaft 22*b* arranged above the middle position of the pressure surface 22*a* as the pivoting fulcrum. Therefore, even when the user's hand comes into contact with the release lever 22, a force which presses the release lever 22 is mainly received at a contact portion between the pivot shaft 22*b* and the case 25, and hence the release lever 22 remains in the neutral position or in the vicinity thereof. In comparison at least to the comparative example, the distance between the upper end portion of the release lever 22 with which the user's hand is liable to come into contact and the pivot shaft 22*b* is small. Therefore, even when the user's hand comes into contact with the release lever 22, the release lever 22 is unlikely to pivot toward the release position based on the leverage principle. Thus, even when an object such as the user's hand comes into contact with the side edge regulating plate 20*f* from above, unintentional movement of the side edge regulating plate 20*f* can be prevented. Thus, the user is allowed to take appropriate measures such as redo of the placement operation.

In the second embodiment, the side edge regulating plate 20*f* can be moved outward in the width direction by the single operation of pressing the release lever 22 in the predetermined pressing direction D1 (see FIG. 14B) as in the comparative example. In the configuration having high operability described above, the pivoting fulcrum of the release lever 22 is arranged above the middle position of the pressure surface 22*a*. Therefore, ensuring of the operability of the side edge regulating plate 20*f* and the reduction of the position misregistration can be both achieved.

In the second embodiment, the pivot shaft 22*b* of the release lever 22 is arranged at a height as close as possible to a height of the upper end p1 of the pressure surface 22*a*. Meanwhile, at least part of the concave and convex shapes serving as the friction portion is arranged in the lower part of the pressure surface 22*a*. Specifically, the friction portion which is provided to allow the pressing force to be easily received when the user intentionally presses the release lever 22 is arranged at a position far from the pivoting fulcrum. Therefore, the user can move the release lever 22 to the release position with a relatively small force (at least the same degree of force as that in the comparative example).

Other Embodiments

In the embodiments described above, the feed cassette to be mounted in the apparatus main body of the image forming apparatus has been described as an example. However, the present invention may be applied to other sheet stacking apparatus such as the manual feed tray 6 (see FIG. 1) or a sheet storage section for an optional feeder additionally provided to the apparatus main body 201A.

The stoppers 11 and 21 are each an example of the mechanism which locks the regulating member such as the trailing edge regulating plate and the side edge regulating plate, and other mechanisms may be used therefor. In this case, the operating portion may be arranged on a side surface which is different from the regulating surface of the sheet regulating unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-100257, filed May 19, 2017, which is hereby incorporated by reference herein in its entirety.

What is claimed is:

1. A sheet stacking apparatus, comprising:

a sheet stacking unit configured to stack a sheet thereon; and a sheet regulating unit movable with respect to the sheet stacking unit, the sheet regulating unit including:

a main body having a regulating surface which is brought into abutment against an edge of the sheet stacked on the sheet stacking unit to regulate a position of the sheet; and an operating portion having a pressable pressure surface, moved from a first position to a second position by pressing the pressure surface, and pivotably supported on the main body about a pivoting fulcrum positioned above a middle position of the pressure surface, the main body being regulated from moving with respect to the sheet stacking unit when the operating portion is in the first position, and the main body being allowed to move with respect to the sheet stacking unit when the operating portion is in the second position, wherein the operating portion moves from the first position to the second position by pressing the pressure surface in a direction away from the edge of the sheet to be regulated by the regulating surface.

2. A sheet stacking apparatus according to claim 1, wherein the sheet regulating unit comprises:

an urging member configured to urge the operating portion toward the first position; and an engagement member engageable with an engaged portion formed on the sheet stacking unit, the engagement member engaged with the engaged portion to regulate the main body from moving when the operating portion is in the first position, and disengaged from the engaged portion to allow the main body to move when the operating portion is in the second position, and wherein, when the pressure surface is pressed, the operating portion is moved to the second position against an urging force of the urging member, and the sheet regulating unit is enabled to be moved by a pressing force received by the operating portion.

3. A sheet stacking apparatus according to claim 1, wherein the operating portion has a shaft portion, which extends in a direction parallel to the regulating surface when viewed from above and is supported on the main body, and pivots about the shaft portion as the pivoting fulcrum.

4. A sheet stacking apparatus according to claim 1, wherein the pressure surface has a friction portion having a plurality of convex and concave shapes, and at least a part of the friction portion is arranged below the middle position of the pressure surface.

5. A sheet stacking apparatus according to claim 1, further comprising a sheet feed unit configured to feed a sheet stacked on the sheet stacking unit in a sheet feed direction, wherein the sheet regulating unit is a trailing edge regulating member configured to regulate a position of an upstream edge of a sheet stacked on the sheet stacking unit with respect to the sheet feed direction.

6. A sheet stacking apparatus according to claim 1, further comprising a sheet feed unit configured to feed a sheet stacked on the sheet stacking unit in a sheet feed direction, wherein the sheet regulating unit is a side edge regulating member configured to regulate a position of an edge of a sheet stacked on the sheet stacking unit in a width direction perpendicular to the sheet feed direction.

7. An image forming apparatus, comprising:

a sheet stacking apparatus, including:

a sheet stacking unit configured to stack a sheet thereon; and a sheet regulating unit movable with respect to the sheet stacking unit, and an image formation unit configured to form an image on a sheet fed from the sheet stacking apparatus, the sheet regulating unit including:

a main body having a regulating surface which is brought into abutment against an edge of the sheet stacked on the sheet stacking unit to regulate a position of the sheet; and an operating portion having a pressable pressure surface, moved from a first position to a second position by pressing the pressure surface, and pivotably supported on the main body about a pivoting fulcrum positioned above a middle position of the pressure surface, the main body being regulated from moving with respect to the sheet stacking unit when the operating portion is in the first position, and the main body being allowed to move with respect to the sheet stacking unit when the operating portion is in the second position, wherein the operating portion moves from the first position to the second position by pressing the pressure surface in a direction away from the edge of the sheet to be regulated by the regulating surface.

* * * * *